United States Patent [19]

Takai

[11] 3,979,894

[45] Sept. 14, 1976

[54] FALSE-TWISTING APPARATUS FOR PRODUCING CRIMPS IN FILAMENT YARNS

[75] Inventor: Isao Takai, Komatsu, Japan

[73] Assignee: Oda, Gosen Kogyo Kabushiki Kaisha, Komatsu, Japan

[22] Filed: Jan. 15, 1975

[21] Appl. No.: 541,196

Related U.S. Application Data

[63] Continuation of Ser. No. 321,978, 01/08/73, abandoned

[30] Foreign Application Priority Data

Sept. 29, 1972 Japan ..... 47-97157

[52] U.S. Cl. ..... 57/77.4; 57/77.4 S; 242/155 M

[51] Int. Cl.[2] ..... D02G 1/04

[58] Field of Search ..... 57/77.3–77.45, 57/34 HS; 242/155 M

[56] References Cited

UNITED STATES PATENTS

| | | | |
|---|---|---|---|
| 2,586,037 | 2/1952 | Heffelfinger | 242/155 M |
| 3,021,663 | 2/1962 | Findlow | 57/77.4 |
| 3,103,097 | 9/1963 | Meili et al. | 57/77.4 |
| 3,113,746 | 12/1963 | Steen | 242/155 M |
| 3,287,890 | 11/1966 | McIntosh et al. | 57/77.4 |
| 3,482,384 | 12/1969 | Berger, Jr. | 57/77.4 X |
| 3,670,488 | 6/1972 | Richter | 57/77.4 |

FOREIGN PATENTS OR APPLICATIONS

| | | | |
|---|---|---|---|
| 640,194 | 4/1962 | Canada | 57/77.4 |
| 892,791 | 3/1962 | United Kingdom | 57/77.4 |
| 821,460 | 10/1958 | United Kingdom | 57/77.3 |
| 892,792 | 3/1962 | United Kingdom | 57/77.4 |

*Primary Examiner*—Richard C. Queisser
*Assistant Examiner*—Charles Gorenstein
*Attorney, Agent, or Firm*—Cushman, Darby & Cushman

[57] ABSTRACT

A false-twisting apparatus for producing crimps in filament yarns, comprising: a first group of endless belts each having a straightly extending region between two spaced pulleys; about which it is entrained a second group of belts arranged in vertically zigzag fashion relative to the belts of the first group and each belt of the second group having a straightly extending region between two spaced pulleys about which it is entrained. The straightly extending regions of the second group of belts are positioned in vertical zig-zag and parallel fashion relative to the adjacent similar regions of the belts of the first group the belts of the second group are driven to travel in a direction opposite to that of travel of each of the belts of the first group. Means, further, are provided for detecting the fluctuation in the tension of the filament yarns which are passed in successive contact with the contact surfaces of these straightly extending regions of the belts in zig-zag fashion; as are means for adjusting the positions of inlet and outlet guides of the filament yarns operatively coupled to said tension fluctuation detecting means; and means for adjusting the parallel distances between the respective straightly extending regions of the belts. This apparatus can be operated at a very high speed under a relatively low tension on the filament yarns and insures the production of evenly crimped yarns of high quality at low production as well as construction costs and can occupy less floor area.

4 Claims, 4 Drawing Figures

FALSE-TWISTING APPARATUS FOR PRODUCING CRIMPS IN FILAMENT YARNS

This application is a continuation of my copending parent application Ser. No. 321,978, filed Jan. 8, 1973, and now abandoned.

BACKGROUND OF THE INVENTION a. Field of the present invention:

The present invention is concerned with a false twisting apparatus for producing crimps in filament yarns, which is used in the manufacture of crimped yarns by the false twisting method.

b. Description of the prior art:

The conventional false twisting apparatuses can be divided roughly into the spindle system and the friction system. The spindle system has the advantage that the tension applied to the filament yarns located on that side where they are subjected to false twisting can be made relatively small. This system which requires a spindle for each filament yarn has a technical problem in that the respective spindles have to be rotated at an ultra-high speed in order to enhance the production efficiency. The friction system, on the other hand, has the inconvenience that, since no desired false twisting can be accomplished if the tension on the filament yarns located on the false twisting side is small, this tension on that side will necessarily have to be increased substantially.

SUMMARY OF THE INVENTION

It is, therefore, an object of the present invention to eliminate the aforesaid drawbacks and inconveniences of the false twisting apparatuses of the prior art and to provide an improved apparatus which does not require spindles to be rotated at high speed and can accomplish false twisting of a number of filament yarns simultaneously and at a relatively small tension on that portion of each of the filament yarns located on that side subjected to false twisting.

Another object of the present invention is to provide the apparatus of the type described, which can be easily driven at a very high speed.

Still another object of the present invention is to provide the apparatus of the type described which further can manufacture evenly crimped filament yarns by the mere adjustment of the tension applied to the filament yarns.

BRIEF DESCRIPTION OF THE DRAWINGS

The drawings shown an example of the apparatus of the present invention.

DETAILED DESCRIPTION OF THE PREFERRED EMBODIMENT

Figure 1:
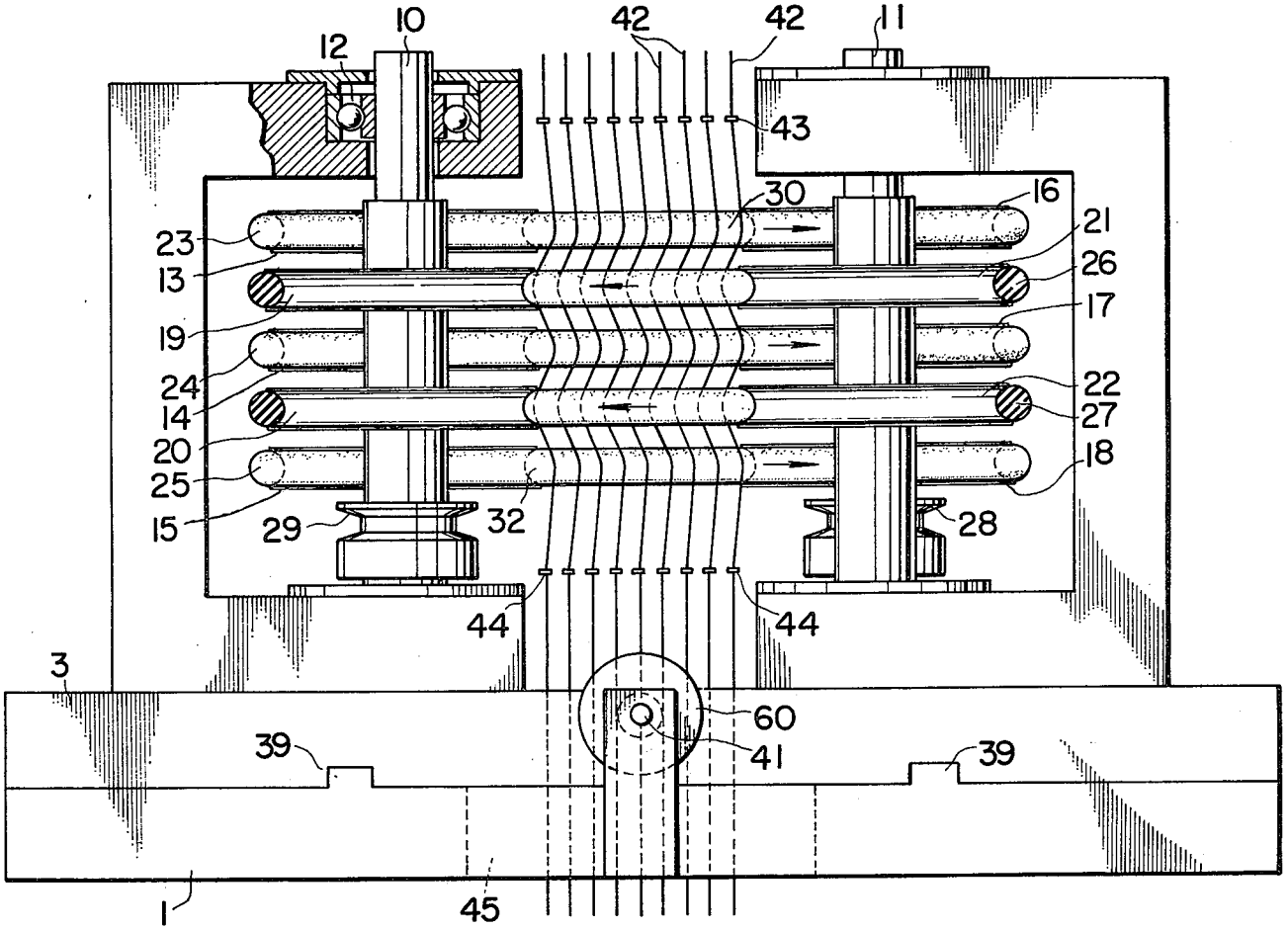
FIG. 1 is a front view of the apparatus partly broken away.

Description will hereunder be made on a preferred example of the apparatus of the present invention by referring to the accompanying drawings.

The drawings show a preferred embodiment of the present invention. In the drawings, reference numeral 1 represents the attachment base frame. A fixed board 2 and a slidable board 3 are mounted on this base frame 1. A pair of frames 4 and 5 are secured to the fixed board 2 by screws. Another pair of frames 6 and 7 are secured to the slidable board 3 by screws. A pulley shaft 8 is rotatably provided on the frame 4 via an upper and a lower bearing 12. In the same manner, a pulley shaft 9 is rotatably provided on the frame 5 forming a pair with the pulley shaft 8, and another pulley shaft 10 is rotatably provided on the frame 6 and a still another pulley shaft 11 is rotatably provided on the frame 7 forming another pair. The pulley shafts 8 and 9 each has three spaced pulleys 13, 14 and 15, and 16, 17 and 18 mounted on their corresponding shafts 8 and 9. Whereas, the pulley shafts 10 and 11 each has two spaced pulleys 19 and 20, and 21 and 22. These shaft pulleys 19 and 21 are arranged at a level lower than that of the pulleys 13 and 16. The pulleys 14 and 17 are arranged at a level lower than that of the pulleys 19 and 21. The pulleys 20 and 22 are arranged at a level lower than that of the pulleys 14 and 17. And the pulleys 15 and 18 are arranged at a level lower than that of the pulleys 20 and 22. Thus, the respective pairs of pulleys are arranged in a zig-zag fashion relative to each other. A rubber belt 23 having a circular cross section is applied between the pulleys 13 and 16. A similar belt 24, 25, 26 or 27 is applied in the similar way between the pulleys 14 and 17, 15 and 18, 19 and 21, and 20 and 22, respectively.

The belts 23, 24 and 25 forming the first group are caused to travel under the same conditions by driving the V-belt pulley 28 mounted on the pulley shaft 9. The belts 26 and 27 forming the second group are caused to run under the same conditions by driving the V-belt pulley 29 mounted on the pulley shaft 10. The respective belts 23, 24, 25, 26 and 27 are applied between their corresponding pulleys in such a way that these belts have regions 30, 31, 32, 33 and 34 extending straightly between their mating pair of pulleys, respectively. These straightly extending regions of the belts are parallel with each other and arranged in spaced zig-zag fashion relative to each other so that the filament yarns 42 can be carried therealong under a tension. It should be noted that these belts are driven in such a way that the straightly extending regions 30, 31 and 32 of the first group of belts 23, 24 and 25 travel in a direction opposite to that of the travel of the straightly extending regions 33 and 34 of the second group of belts 26 and 27.

The fixed board 2 is fixed to the attachment base frame 1 by utilizing bolt-receiving holes 35 and 36. It should be understood, however, that, where required, in place of fixing the board 2 to the frame 1, the board 2 may be arranged so that it can be rotated horizontally about the shaft axis of the pulley shaft 9 as shown by the two-dot chain line in FIG. 2.

Figure 2:
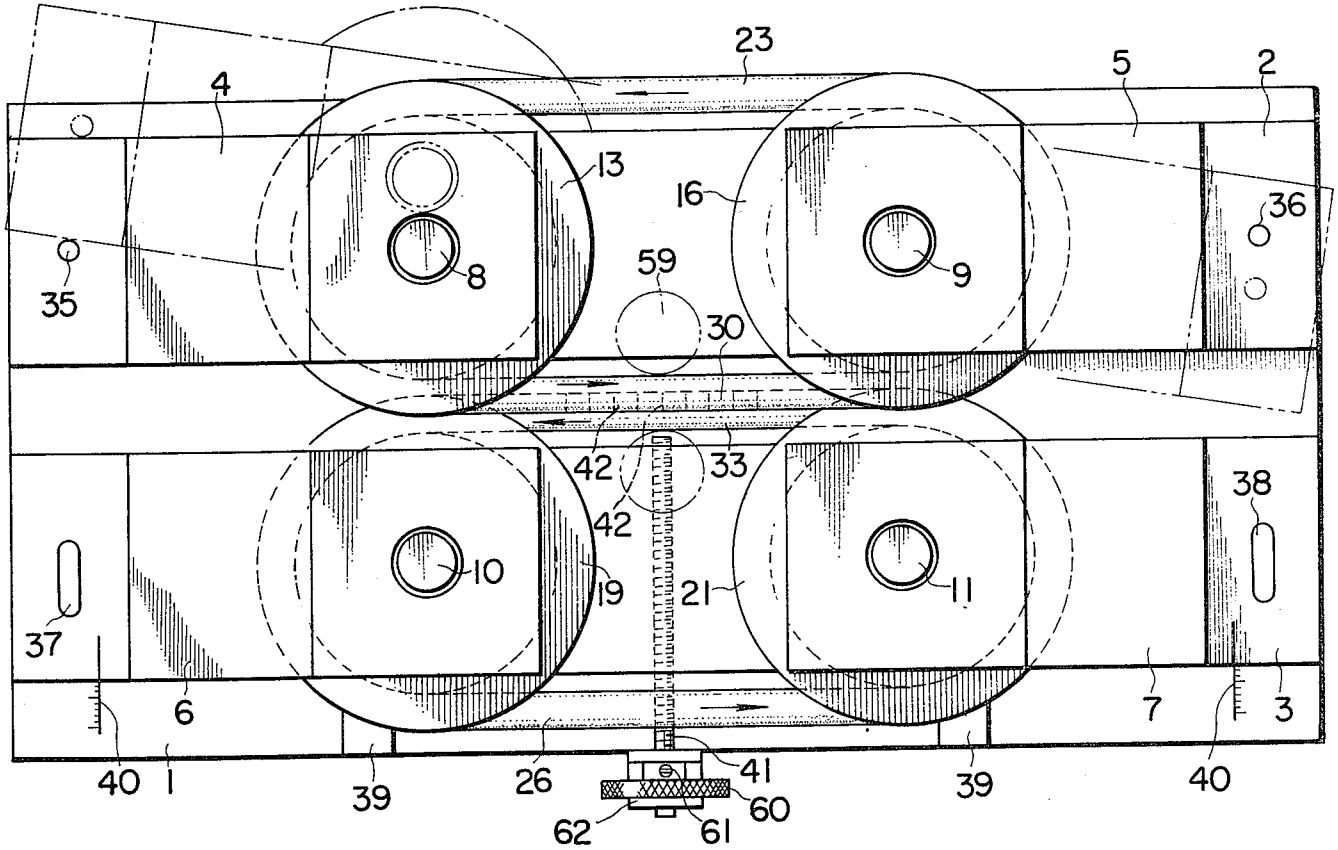
FIG. 2 is a plan view of same.
Figure 3:
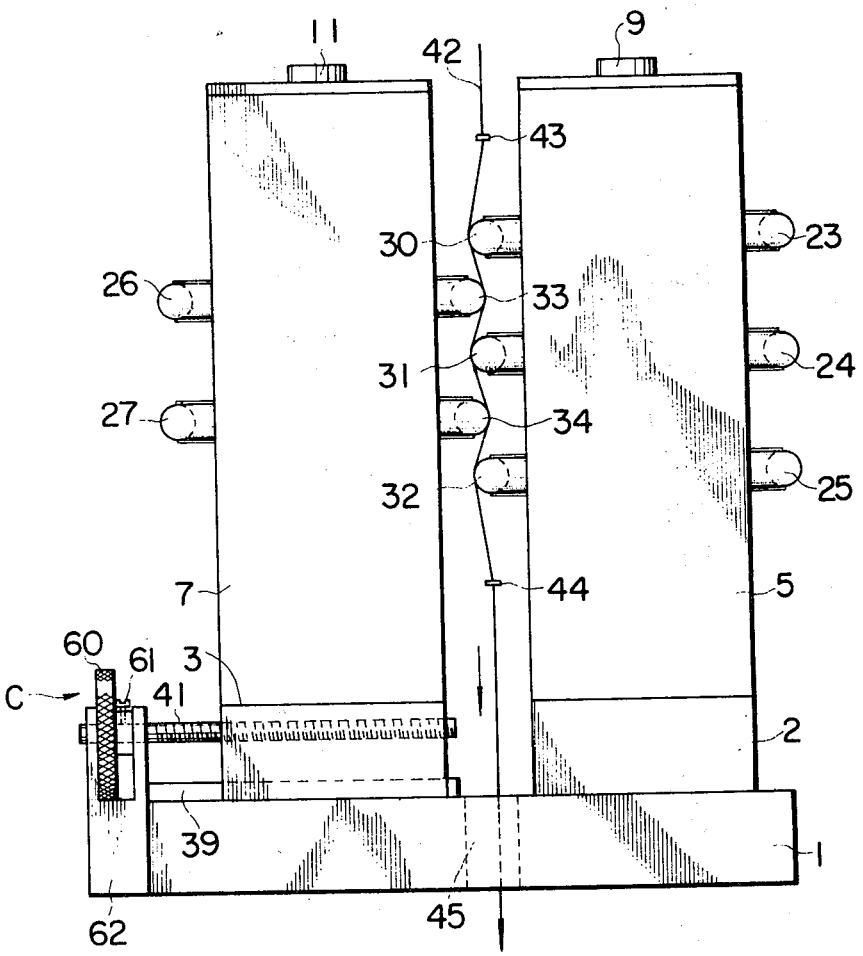
FIG. 3 is a side view of same.

The slidable board 3 is mounted on the attachment base frame 1 in such a way that it can make sliding movements along a guide roll 39 relative to this base frame 1 in a direction perpendicular to the sheet of drawing in FIG. 1, and vertically in FIG. 2, and sideways in FIG. 3. It should be understood that, where required, this slidable board 3 can be fixed to the attachment base frame 1 by utilizing the lengthy bolt-receiving holes 37 and 38. By sliding this slidable board 3, it is possible to adjust the parallel distances between the straightly extending regions 30, 31, 32 of the belts 23, 24, 25 of the first group and the straightly extending regions 33, 34 of the belts 26, 27 of the second group.

This adjustment may be performed manually while watching the graduations 40 provided on the attachment base frame 1. However, since in this example, the adjustment screw 41 of the distance adjusting means threadably engages the slidable board 3, the adjustment is to be made by rotating the adjustment screw 41. A round knob 60 is fixed by a screw 61 to the adjustment screw 41. The round knob 60 is rotatably received within a fixed U-shaped guide 62 which is fixed to the frame 1.

Figure 4:
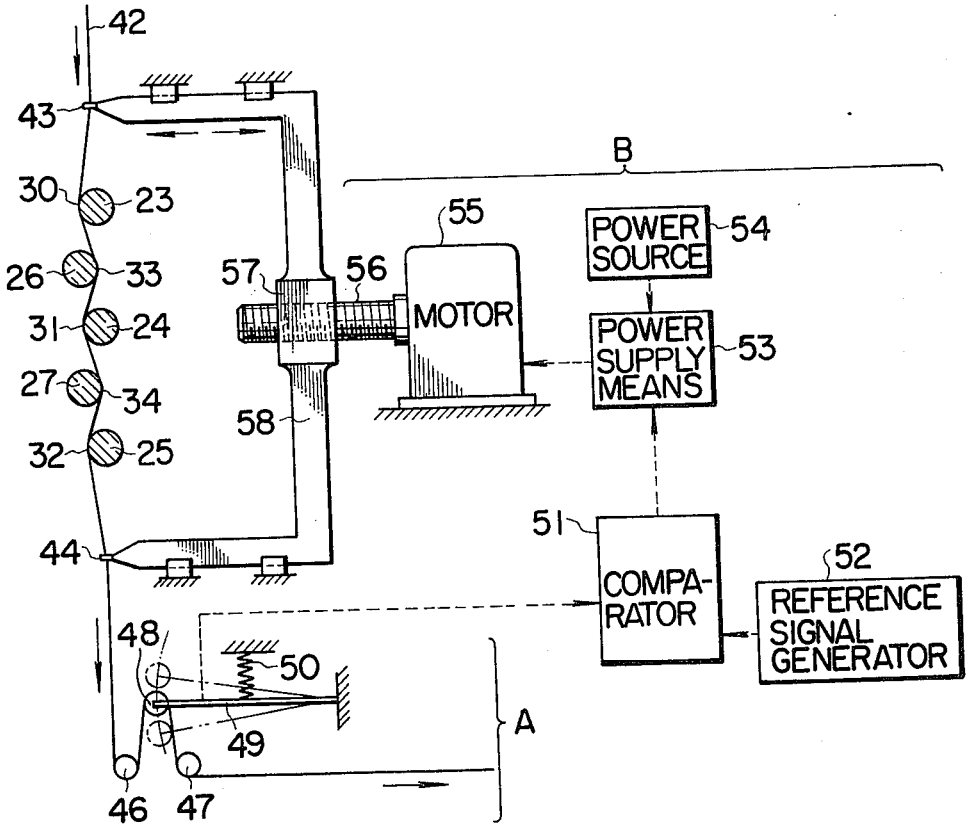
FIG. 4 is an explanatory illustration of the guide position adjusting means.

The filament yarns 42 which are to be subjected to false twisting are false-twisted as they are fed to travel along and in pressure contact successively with the contact surfaces of the straightly extending regions 30, 33, 31, 34, 32 of the belts after they are introduced thereto through the inlet guides 43 as will be described later. Therefrom, the filament yarns 42 pass via the outlet guides 44 and through the opening 45 of the base frame 1 and via a fixed guide 46, a movable guide 48 and a fixed guide 47 of the tension fluctuating detecting means generally indicated at A as shown in FIG. 4.

The movable guide 48 is provided with a strain gauge 49 and with a spring 50. When the tension of the filament yarns takes a value greater than a predetermined value, the movable guide 48 will be caused to be moved downwardly against the force of the spring 50 in FIG. 4. On the contrary, in case the tension of the filament yarns takes a value smaller than a predetermined value, the movable guide 48 is moved upwardly by the spring 50. Accordingly, there develops in said strain gauge 49 a strain corresponding to the tension actually applied to the filament yarns. This tension is detected on the developed strain. As a result, an electric signal corresponding to this tension is transmitted to a comparator 51. Since an electric signal corresponding to the reference tension is being transmitted to this comparator 51 from the reference signal generator 52, there is effected by this comparator 51 a comparison between these two signals applied. The detected difference between them is amplified and generated by the comparator 51 as a comparison signal. This comparison signal is such that a differentiation of positive or negative as the result of comparison relative to the reference signal is also contained. Such a comparison signal is transmitted to means 53 for supplying power to a driving electric motor. This means 53 controls the supply of power from a power source 54 to the motor 55 assigned to adjust the position of the guides upon receipt of said comparison signal. A threaded shaft 56 is coupled to the rotor of the motor 55. This threaded shaft 56 threadably engages the nut portion 57 of the guide-supporting frame 58 on which the guides 43 and 44 are supported. When the tension of the filament yarns is detected to be smaller than the predetermined value, the motor 55 will be rotated in the positive direction so that the guide supporting frame 58 is moved towards the right side in FIG. 4 to increase the angle of contact of the filament yarns at which the filament yarns 42 contact the surfaces of the belts 23 and 25, thereby augmenting the tension of the filament yarns. On the contrary, in case the tension is detected to be greater than the predetermined value, the motor 55 will be rotated in the reverse direction to move the guide-supporting frame 58 towards the left side in FIG. 4, thereby decreasing the tension of the filament yarns.

With the false twisting apparatus for producing crimps in filament yarns having the aforesaid arrangement, the operation will be performed in the manner as stated below. At the time of starting the apparatus, the fixed board 2 is rotated about the shaft axis of that one pulley shaft 9 as shown by the two-dot chain lines given in FIG. 2, to widen the distance between the straightly extending regions 30, 31, 32 of the belts 23, 24, 25 of one group and the straightly extending regions 33, 34 of the belts 26, 27 of the other group. Filament yarns 42 to be false-twisted are passed via the inlet guides 43 between and along the straightly extending regions 30, 33, 31, 34 and 32 while in contact successively with the surfaces of these regions, and therefrom the filament yarns 42 are passed through the outlet guides 44, and then through the fixed guide 46, the movable guide 48 and the fixed guide 47.

Next, the fixed board 2 is adjusted in its position so that the straightly extending regions 30, 31, 32, are rendered parallel with those regions 33, 34 as shown in solid lines given in FIG. 2. Then, by utilizing the bolt-receiving holes 35 and 36, the fixed board 2 is threadably fixed to the attachment base frame 1.

Then, by rotating the round knob 60 which is fixed to the adjustment screw 41 while watching the graduations 40 provided on the attachment base frame 1, the adjustment screw 41 is rotated so that the slidable board 3 is caused to slide along the guide rail 39. When there is thus established an optimum parallel distance between the straightly extending regions 30, 31, 32 and those 33, 34 relative to the filament yarns 42, the slidable board 3 is temporarily threadably fixed to the attachment base frame 1 by utilizing the lengthy bolt-receiving holes 37 and 38.

Next, the V-belt pulleys 28 and 29 are driven to cause the straightly extending regions 30, 31, 32 of the belts 23, 24, 25 of the first group to travel in one direction and, along with this, to cause the straightly extending regions 33, 34 of the belts 26, 27 of the second group to run in the opposite direction. At the same time therewith, the respective filament yarns 42 are simultaneously introduced into the apparatus via the inlet guide 43 to travel towards the outlet guide 44 in a manner as shown in FIGS. 1, 3 and 4.

Whereupon, the filament yarns 42 pass along the straightly extending regions 30, 33, 31, 34, 32 while successively contacting their surfaces under tension. Since those straightly extending regions 30, 31, 32 travel in a direction opposite to that of the travel of the straightly extending regions 33 and 34, the filament yarns 42 are given the required false twisting during their passage on these two groups of straightly extending regions.

In general, filament yarns 42 which are to be subjected to a crimp-developing process have oil adhering thereto. Thus, the tension of such filament yarns 42 which are being processed on the apparatus tends to decrease from the reference value for a certain length of time after the operation of the apparatus is started. So long as the decrease in the tension remains within a small value, the means for adjusting the positions of guides shown and generally indicated at B in FIG. 4 is actuated to correct the drop of tension to a normal value. However, there may be detected a tendency that the tension drops to such an extent as can no longer be corrected to a normal value by the action of the guide position adjusting means alone. In such an instance, the fastening bolts threaded into the lengthy bolt-receiving holes 37 and 38 and intended for temporarily threadably fixing the slidable board 3 to the attachment base frame 1 are unscrewed. Then, the round knob 60 is turned in such a direction as will cause the slidable board 3 to approach the fixed board 2, thereby rotating the adjustment screw 41 of the means for adjusting the parallel distances of the straightly extending regions, which means being generally indicated at C. Thus, the slidable board 3 is caused to move towards the fixed board 2 in parallel therewith. Whereupon, there occurs a change in the parallel distance between the straightly extending regions 30, 31, 32 and those 33, 34. In other words, the straightly extending regions 33, 34 of the belts 26, 27 of the other group will move so as to exert themselves deeper into the spaces in a zig-zag fashion between the straightly extending regions 30, 31, 32 of the belts 23, 24, 25 of the first group. As a result, the filament yarns 42 will be caused to have a broaded contact successively with the contact surfaces of these straightly extending regions of belts. Thus, the tension of the filament yarns 42 will increase accordingly. After the tension of the filament yarns 42 has thus been corrected to the proper value, the slidable board 3 is threadably fixed to the attachment base frame 1. It should be understood, of course, that, wherever there is the need to move the slidable board 3 away from the fixed board 2, it is only necessary to turn the adjustment screw 41 in the direction opposite to that described above.

As discussed above, the apparatus of the present invention comprises belts of a first group each being applied between two spaced pulleys and each having a straightly extending region between its two pulleys, and belts of the second group each being applied between two spaced pulleys other than those for the first group and arranged in zig-zag fashion relative to the belts of the first group and having a straightly extending region between its two pulleys and being spaced from each of the belts of the first group in parallel relationship therewith and being permitted to travel in a direction opposite to that of travel of each of the similar regions of the belts of the first group, there being provided an arrangement that filament yarns to be subjected to a crimp-developing false-twisting process are passed between and along the straightly extending regions of the belts of said two groups while the filament yarns are successively brought into zig-zag contact with the contact surfaces of all of these straightly extending regions one after another. Thus, it is possible to accomplish the crimp-developing false-twisting process of a number of filament yarns simultaneously under the same conditions by a single false-twisting apparatus to develop crimps in these filament yarns. Therefore, the apparatus of the present invention not only is suitable for mass production, but also there is no need of increasing the number and the capacity of the heating means used for the crimp-developing purpose in proportion to an increase in the number of the filament yarns to be processed. As a result, the cost of construction and operation can be markedly reduced. Moreover, false-twisting of the crimp-developing yarns is performed by the cooperation of (a) those straightly extending regions of belts of the first group which run in a certain direction and (b) those straightly extending regions of belts of the second group which travel in the opposite direction. Therefore this false-twisting operation is accomplished with no failure. Furthermore, even in case the filament yarns tend to be carried along in the direction of travel of the straightly extending regions of belts of the first group, such a tendency is off set by the fact that the filament yarns are carried back in the opposite direction by the straightly extending regions of belts of the second group. Accordingly, there is no fear whatsoever that the adjacently disposed individual filament yarns become entangled with each other during the false-twisting operation. In addition, the crimp-developing process is performed on the filament yarns under the condition of a low tension. This means that the filament yarns at the setting zone have a small tension which is very desirable. Not only that, but also the detection of the possible fluctuation in the tension of the filament yarn as well as the measurement of this fluctuating tension can be made very easily. Also, an increase in the speed of travel of the belts ot raise the speed of the crimp-developing false-twisting process may be effected by increasing the speed of rotation of the pulleys. In case, however, there is a limitation to the speed of rotation of the pulleys, an increase in the speed of travel of the belts may be materialized easily by increasing the diameter of the pulleys.

Furthermore, an apparatus having means for adjusting the parallel distance between the straightly extending regions of belts of the first group and the straightly extending regions of belts of the second group will allow this distance to be adjusted either beforehand or during the operation in accordance with the property of the filament yarns to be subjected to a crimp-developing false twisting. As a result, it is possible to obtain excellent crimped yarns having a desirable physical property. Also, an apparatus having means for detecting the fluctuations in the tension of the filament yarns and having means for adjusting the positions of the inlet-side guides and the outlet-side guides by moving them in accordance with the signal received from said fluctuating tension detecting means, will function so that the fluctuation is detected and the guides are moved, thereby the tension of the filament yarns is regulated to a correct and proper value. Thus, crimp-developing process can be performed always under the optimum tension of the filament yarns, so that it is possible to obtain evenly crimped yarns having no uneven twists.

The aforesaid example of the apparatus has been described with respect to an instance where two groups of belts, one of which being constituted by three belts and the other constituted by two belts, are employed. By the use of such plural number of belts in two groups, there can be performed an operation which produces satisfactory crimps in filament yarns. It should be noted, however, that the use of only two belts — one of which is positioned on a level lower than the other and caused to travel in a direction opposite to that of travel of the other belt — is also possible, though the effect of the false-twisting operation may not be as good as that obtained from an apparatus having more than two sets of belts.

As stated above, the apparatus of the present invention is simple in structure and reliable in function and requires a reduced floor area for its construction. Thus, this invention has many advantages when put into practice.

I claim:

1. A false-twisting apparatus for producing crimps in filament yarns comprising:

a first pair of laterally spaced shafts one of which is an idler;

at least one first pair of laterally spaced pulleys respectively secured to said shafts;

at least one first endless belt entrained about said first pulleys;

first gearless means including a pulley-belt drive on the other of said first pair of shafts for driving said first endless belt to travel in a given direction around a given elongated circular path under tension;

said first endless belt having on one side of said path a straightly extending region between said first pulleys, said region presenting a yarn contact surface, rounded in transverse cross-section, on which the filament yarns are brought into contact at successive locations therealong as they are fed thereto;

a second pair of laterally spaced shafts disposed adjacent said first pair of shafts, one shaft of said second pair being an idler;

at least one second pair of laterally spaced pulleys respectively secured to said second pair of shafts at a height level different than said first pulley pair;

at least one second endless belt entrained about said second pulleys;

second gearless means including a pulley-belt drive on the other of said second pair of shafts for driving said second endless belt to travel in said given direction around its own given elongated circular path under tension at a location spaced vertically from the first belt;

said second endless belt having on the side of its own said circular path which generally faces toward and in the opposite direction as the said one side of said path for said first endless belt a straightly extending region between said second pulleys, said region of this second belt being parallel with the straightly extending region of the first belt and presenting a yarn contact surface, rounded in transverse cross-section, on such side that this surface can be brought into pressure contact at successive locations therealong with the filament yarns which have passed the yarn contact surface of the straightly extending region of the first belt;

said first and second gearless means for driving said first and second endless belts being operative for positively driving two pulleys respectively from said first and second pairs and at opposite ends thereof for causing the said generally facing sides of both said belts to be in pulling tension at all times;

means for detecting the fluctuations in the tension of the filament yarns, said means being provided on the filament yarn outlet side of the apparatus;

inlet and outlet guide means for each filament yarn for guiding the filament yarns to traverse across each said yarn contact surface;

means for adjusting the positions of said inlet and outlet guide means of the filament yarns, said adjusting means being operatively associated with said tension fluctuation detecting means;

means for adjusting the magnitude of overlap between the straightly extending regions of the first and the second belts, whereby increasing the overlap increases the lenghts along the filament yarns of contact of the filament yarns with the yarn contact surfaces; and means for maintaining all said straightly extending regions parallel to each other throughout their lengths before, during and after said overlap adjustment.

2. A false-twisting apparatus according to claim 1, in which each of said belts is of a circular cross section.

3. A false-twisting apparatus according to claim 1, in which: said means for detecting the fluctuations in the tension of the filament yarns comprises a combination of a first fixed guide provided downstream of the outlet guides, a movable guide provided downstream of said fixed guide, strain gauge means mounting said movable guide, cantilever fashion, an urging spring connected to the strain gauge means and tending to urge the movable guide in a sense to tension the filament yarns, and another fixed guide provided downstream of said movable guide, said means for adjusting the positions of the inlet and outlet guides comprises a combination of: a reference tension signal generator; a filament yarn tension comparator coupled to said reference tension signal generator to constantly receive a reference signal from said generator and coupled to said strain gauge to receive tension fluctuation signals therefrom and to generate a comparison signal after comparing these two signals; power supplying means coupled to a power source and to said comparator to receive the signal generated therefrom and to supply power in direct response to this signal; a motor driven by the power supplied from the power supply means to adjust the positions of the inlet and outlet guides; and guide supporting frame for supporting said inlet and outlet guides and operatively connected to said motor.

4. A false-twisting apparatus according to claim 1 including:

at least one additional pair of laterally spaced pulleys having a respective endless belt entrained thereabout and being respectively secured to said first pair of laterally spaced shafts;

at least one further additional pair of laterally spaced pulleys having a respective endless belt entrained thereabout and being respectively secured to said second pair of shafts;

said first pair of pulleys, said second pair of pulleys, said one additional pair of pulleys and said further additional pair of pulleys being secured to their respective shafts at different height levels therealong in the order named so that filament yarns moving in the general direction of said shafts and between said belts will be caused to move in a zigzag manner from one belt to the next because successive belts are driven in opposite directions by said first and second gearless driving means;

said one additional and further additional endless belts being rounded in transverse cross-section at least on their respective yarn contacting surface sides.

* * * * *